United States Patent [19]

Inokuti et al.

[11] Patent Number: 4,985,635

[45] Date of Patent: Jan. 15, 1991

[54] METHOD OF PRODUCING EXTRA-LOW IRON LOSS GRAIN ORIENTED SILICON STEEL SHEETS

[75] Inventors: Yukio Inokuti; Yoh Ito, both of Chiba, Japan

[73] Assignee: Kawasaki Steel Corporation, Kobe, Japan

[21] Appl. No.: 444,050

[22] Filed: Nov. 30, 1989

Related U.S. Application Data

[62] Division of Ser. No. 95,527, Sep. 10, 1987.

[30] Foreign Application Priority Data

| | | | |
|---|---|---|---|
| Sep. 16, 1986 | [JP] | Japan | 61-215835 |
| Oct. 11, 1986 | [JP] | Japan | 61-240189 |
| Jan. 28, 1987 | [JP] | Japan | 62-16123 |
| Feb. 10, 1987 | [JP] | Japan | 62-27386 |

[51] Int. Cl.[5] ..... H01F 1/04

[52] U.S. Cl. ..... 250/492.300; 250/492.1; 250/453.1

[58] Field of Search ..... 250/492.3, 453.1, 454.1, 250/455.1, 492.1, 492.2; 148/113, 308

[56] References Cited

U.S. PATENT DOCUMENTS

| | | | |
|---|---|---|---|
| 2,989,633 | 6/1961 | Wilson | 250/453.1 |
| 3,081,485 | 3/1963 | Steigerwald | 250/492.3 |
| 3,564,238 | 2/1971 | Martin et al. | 250/492.3 |
| 3,634,645 | 1/1972 | Lempert | 250/492.3 |
| 3,676,673 | 7/1972 | Coleman | 250/492.3 |
| 4,252,413 | 2/1981 | Mablo | 250/492.3 |
| 4,482,811 | 11/1984 | Burgess | 250/492.3 |
| 4,845,370 | 7/1989 | Thompson et al. | 250/492.3 |

*Primary Examiner*—Jack I. Berman
*Assistant Examiner*—Kiet T. Nguyen
*Attorney, Agent, or Firm*—Austin R. Miller, Esq.

[57] ABSTRACT

An extra-low iron loss grain oriented silicon steel sheet is produced by irradiating electron beam to an insulation coating formed on a grain oriented silicon steel sheet after finish annealing in a direction crossing the rolling direction of the sheet, whereby the magnetic properties are not degraded even if the steel sheet is subjected to a strain relief annealing. If necessary, an inert gas may be introduced into the vicinity of electron beam irradiated zone of the coating.

2 Claims, 3 Drawing Sheets

METHOD OF PRODUCING EXTRA-LOW IRON LOSS GRAIN ORIENTED SILICON STEEL SHEETS

This is a division, of application U.S. patent application Ser. No. 095,527, filed Sept. 10, 1987.

BACKGROUND OF THE INVENTION

1. Field of the Invention

This invention relates to a method of producing an extra low iron loss grain oriented silicon steel sheet, and more particularly it is to conduct refinement of magnetic domains and hence advantageous improvement of iron loss properties by subjecting a coating layer formed after finish annealing or a mirror finished steel sheet surface after finish annealing to CVD, ion plating or iron implantation process with nitride, carbide, oxide or the like, forming an insulation coating on the resulting tension layer and then subjecting the coating to electron beam (EB) irradiation in a direction crossing the rolling direction.

2. Related Art Statement

Lately, remarkable developments and efforts for satisfying the improvement of electrical and magnetic properties in grain oriented silicon steels, particularly ultimate demand on reduction of iron loss are gradually producing good results.

As is well-known, the grain oriented silicon steel sheet, wherein secondary recrystallized grains are highly aligned in {110}<001> orientation, namely Goss orientation, is mainly used as a core for transformer and other electrical machinery and equipment. In this case, it is required that the magnetic flux density (represented by $B_{10}$ value) is high, and,the iron loss (represented by $W_{17/50}$ value) is low.

Since these grain oriented silicon steel sheets are usually manufactured through many complicated steps, a great of inventions and improvements are applied to the above steps, whereby low iron loss grain oriented silicon steel sheets having $B_{10}$ of not less than 1.90 T and $W_{17/50}$ of not more than 1.05 W/kg when the product thickness is 0.30 mm or $B_{10}$ of not less than 1.89 T and $W_{17/50}$ of not more than 0.90 W/kg when the product thickness is 0.23 mm are manufactured up to the present.

Lately, supreme demands on the reduction of power loss become considerable in view of energy-saving. Particularly, a system of "Loss Evaluation' wherein the reduction percentage of iron loss is converted into a money to load on the cost of the transformer in the manufacture of low loss transformer is widely spread in Europe and America.

Under the above circumstances, there has recently been proposed a method wherein local microstrain is introduced into the surface of the grain oriented silicon steel sheet by irradiating a laser beam onto the steel sheet surface in a direction substantially perpendicular to the rolling direction after the finish annealing to thereby conduct refinement of magnetic domains and hence reduce the iron loss (Japanese Patent Application Publication Nos. 57-2,252, 57-53,419, 58-26,405 and 58-26,406).

Such a magnetic domain refinement is effective for the grain oriented silicon steel sheet not subjected to the strain relief annealing, in the manufacture of stacked lamination core type transformers. However, in case of wound-core type transformers, the strain relief annealing is performed after the magnetic domain refinement, so that the local microstrain produced by laser irradiation on purpose is released by the annealing treatment to make the width of magnetic domains wide and consequently the laser irradiating effect is lost.

On the other hand, Japanese Patent Application Publication No. 52-24,499 discloses a method of producing an extra-low iron loss grain oriented silicon steel sheet wherein the surface of the grain oriented silicon steel sheet is subjected to a mirror finishing after the finish annealing or a metal plating is applied to the mirror finished surface or further an insulation coating is baked thereon.

However, the mirror finishing for improving the iron loss does not sufficiently contribute to the reduction of iron loss in comparison with remarkable cost-up of the manufacturing step. Particularly, there is a problem on the adhesion property to the insulation coating indispensably applied and baked after the mirror finishing. Therefore, such a mirror finishing is not yet adopted in the present manufacturing step.

Further, there is proposed a method, wherein the steel sheet surface is subjected to the mirror finishing and then a thin coat of oxide ceramics is deposited thereon, in Japanese Patent Application Publication No. 56-4,150. In this method, however, the ceramic coat is peeled off from the steel sheet surface when subjecting to a high temperature annealing above 600° C., so that it can not be adopted in the actual manufacturing step.

Moreover, Japanese Patent laid open No. 59-229,419 proposes a method wherein a heat energy is locally applied to the surface of the silicon steel sheet to form a heat strain zone. However, the effect based on the preferential formation of such a local heat strain zone is lost by high temperature annealing above 600° C. In addition, there are proposed a method of introducing artificial grain boundary into the silicon steel sheet having a secondary grain size of not less than 3 mm in Japanese Patent laid open No. 58-144,424 and a method of irradiating plasma flame to the grain oriented silicon steel sheet after the finish annealing in Japanese Patent laid open No. 62-96,617. In the latter methods, however, the effect is lost in case of the material for Wound-core type transformer subjected to the strain relief annealing.

SUMMARY OF THE INVENTION

It is an object of the invention to achieve the reduction of iron loss while sufficiently offsetting the aforementioned drawbacks of the conventional techniques.

According to a first aspect of the invention, there is the provision of a method of producing an extra-low iron loss grain oriented silicon steel sheet, which comprises forming an insulation coating composed mainly of a phosphate and colloidal silica on a grain oriented silicon steel sheet after finish annealing, and then irradiating electron beam onto the resulting insulation coating in a direction crossing a rolling direction of the sheet.

In the first aspect of the invention, an inert gas such as Ar, $N_2$ or the like is introduced into the vicinity of electron beam irradiated zone of the coating.

According to a second aspect of the invention, there is the provision of a method of producing an extra-low iron loss grain oriented silicon steel sheet, which comprises removing an oxide layer from a surface of a grain oriented silicon steel sheet after finish annealing, subjecting the steel sheet surface to finish polishing into a mirror state having a center-line average roughness Ra of not more than 0.4 μm, irradiating electron beam to the mirror finished surface in a direction substantially perpendicular to a rolling direction of the sheet, and forming a thin tension coat of at least one layer composed of at least one of nitrides and/or carbides of Ti, Zr, Hf, V, Nb, Ta, Cr, Mo, W, Co, Ni, Al, B and Si and oxides of Al, Ni, Cu, W, Si and Zn through CVD, ion plating or ion implantation process.

According to a third aspect of the invention, there is the provision of a method of producing an extra-low iron loss grain oriented silicon steel sheet, which comprises, removing an oxide layer from a surface of a grain oriented silicon steel sheet after finish annealing, subjecting the steel sheet surface to finish polishing into a mirror state having a center-line average roughness Ra of not more than 0.4 μm, forming a thin tension coat of at least one layer composed of at least one of nitrides and/or carbides of Ti, Zr, Hf, V, Nb, Ta, Cr, Mo, W, Mn, Co, Ni, Al, B and Si and oxides of Al, Ni, Cu, W, Si and Zn through CVD, ion plating or ion implantation process, and irradiating electron beam in a direction crossing a rolling direction of the sheet before or after the formation of an insulation coating composed mainly of a phosphate and colloidal silica.

According to a fourth aspect of the invention, there is the provision of a method of producing an extra-low iron loss grain oriented silicon steel sheet, which comprises removing an oxide layer from a surface of a grain oriented silicon steel sheet after finish annealing, subjecting the steel sheet surface to finish polishing into a mirror state having a center-line average roughness Ra of not more than 0.4 μm, forming a thin tension coat of at least one layer composed of at least one of nitrides and/or carbides of Ti, Zr, Hf, V, Nb, Ta, Cr, Mo, W, Mn, Co, Ni, Al, B and Si and oxides of Al, Ni, Cu, W, Si and Zn, and irradiating electron beam in a direction crossing a rolling direction of the sheet before or after the formation of an insulation coating having an electric conductivity of not less than $10^{10}$ Ω·cm and selected from at least one of $SiO_2$, $Si_3N_4$, SiC, $Al_2O_3$ and BN.

In the third and fourth aspects of the invention, an inert gas such as Ar, $N_2$ or the like is introduced into the vicinity of electron beam irradiated zone of the insulation coating.

According to a fifth aspect of the invention, there is the provision of an apparatus for continuously reducing iron loss in a grain oriented silicon steel sheet, comprising a vacuum treating unit provided with an electron beam irradiation device for irradiating electron beam to the silicon steel sheet in a direction crossing a rolling direction of the sheet, and a pair of exhaust unit rows arranged at entrance and delivery sides of said treating unit and adjusted to gradually increase the vacuum degree toward said treating unit. In the fifth aspect of the invention, the vacuum treating unit is provided with a high vacuum chamber for raising the vacuum degree at the electron beam irradiated zone.

Brief Description of the Drawinqs The invention will be described with reference to the accompanying drawings, wherein.

DESCRIPTION OF THE PREFERRED EMBODIMENTS

Figure 1:
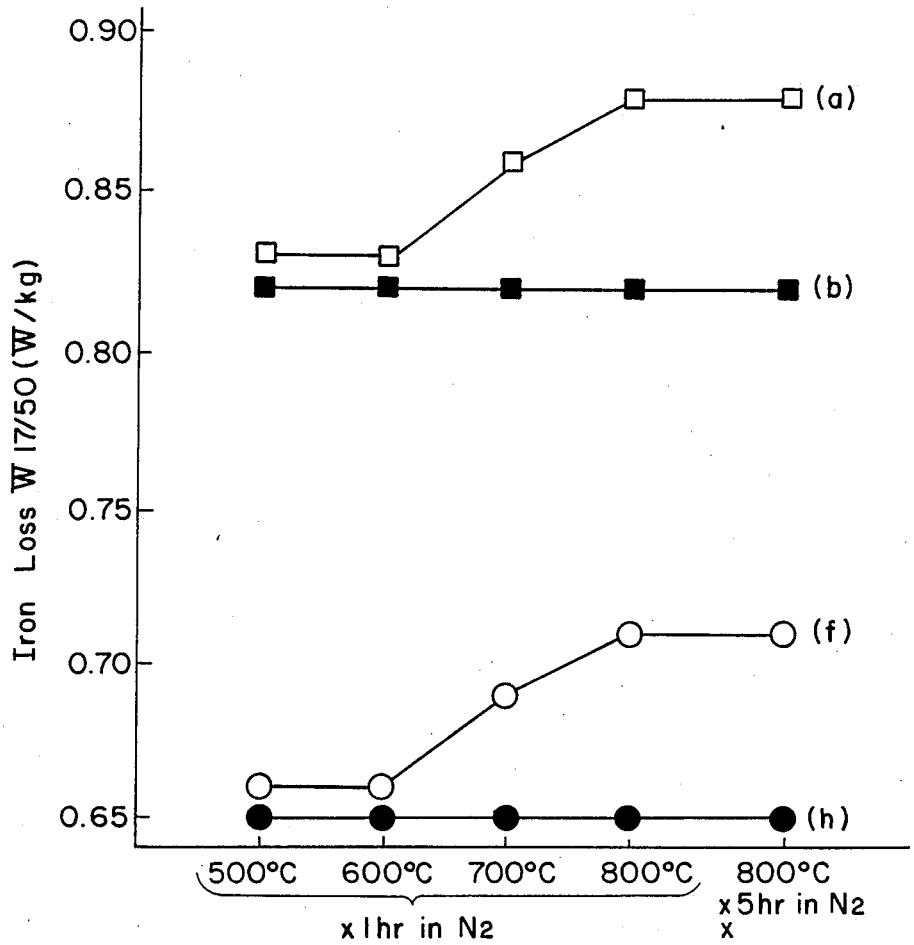
FIG. 1 is a graph showing a change of magnetic properties when the silicon steel sheet is subjected to strain relief annealing after the electron beam irradiation.

The invention will be described in detail with respect to concrete experiments resulting in the success of the invention.

Experiment 1

A continuously cast slab of silicon steel containing C:0.046% by weight (simply shown as % hereinafter), Si:3.44%, Mn:0.068%, Se:0.021%, Sb:0.025% and Mo:0.013% was heated at 1,350° C. for 4 hours and then hot rolled to obtain a hot rolled steel sheet of 2.0 mm in thickness.

The hot rolled steel sheet was subjected to a normalized annealing at 900° C. for 3 minutes, which was then subjected to a cold rolling two times through an intermediate annealing at 950° C. for 3 minutes to obtain a final cold rolled steel sheet of 0.23 mm in thickness.

After the cold rolled steel sheet was subjected to decarburization and primary recrystallization annealing in a wet hydrogen atmosphere at 820° C., a slurry of an annealing separator (A) mainly composed of MgO or an annealing separator (B) composed of inert $Al_2O_3$ (75%) and MgO (25%) was applied to the steel sheet surface. Then, the steel sheet was subjected to a secondary recrystallization annealing at 850° C. for 50 hours and further to a purification annealing in a dry hydrogen atmosphere at 1,200° C. for 5 hours.

Thereafter, a part of the finish annealed steel sheet was subjected to the following treatment (a) or (b).

(a) Electron beam was irradiated to the steel sheet surface in a direction perpendicular to the rolling direction under vacuum (as EB irradiation conditions, acceleration voltage:50 kV, acceleration current: 0.75 mA, beam diameter:0.1 mm, beam scanning space:10 mm).

(b) An insulation coating composed mainly of a phosphate and colloidal silica was formed on the surface of the finish annealed steel sheet, to which was then irradiated electron beam in a direction perpendicular to the rolling direction under vacuum at the same conditions as in the item (a).

For the comparison, there were provided two test sheets, one of which was the finish annealed steel sheet not subjected to EB irradiation (c) and the other of which was the steel sheet provided thereon with the insulation coating after the finish annealing and not subjected to EB irradiation (d).

On the other hand, the remaining finish annealed steel sheet was lightly pickled (in 10% solution of HCl) and subjected to a chemical polishing with a mixed solution of 3% HF and $H_2O_2$ into a mirror state having a center-line average roughness of 0.03 μm, which was then divided into four specimens and treated under the following conditions:

(e) A TiN thin coat of 1.0 μm in thickness was formed on the mirror finished surface of the steel sheet by means of a continuous ion plating apparatus (HCD process);

(f) After a TiN thin coat of 1.0 μm in thickness was formed on the mirror finished surface by means of the continuous ion plating apparatus, electron beam was irradiated in a direction perpendicular to the rolling direction under vacuum (acceleration voltage:45 kV, acceleration current:0.75 mA, beam diameter:0.1 mm, beam scanning space:10 mm);

(g) After a TiN thin coat of 1.0 μm in thickness was formed on the mirror finished surface by means of the continuous ion plating apparatus, an insulation coating composed mainly of a phosphate and colloidal silica was further formed thereon;

(h) After a TiN thin coat of 1.0 μm in thickness was formed on the mirror finished surface by means of the continuous ion plating apparatus and further an insulation coating composed mainly of a phosphate and colloidal silica was formed thereon, electron beam was irradiated in a direction perpendicular to the rolling direction under vacuum at the same conditions as in the item (f).

The magnetic properties of the above treated steel sheets are shown in the following Table 1.

TABLE 1

| Treatment | Test sheet | Insulation coating | EB irradiation | Magnetic properties $B_{10}$ (T) | Magnetic properties $W_{17/50}$ (W/kg) |
|---|---|---|---|---|---|
| (a) | Finish annealed steel sheet | absence | presence | 1.91 | 0.83 |
| (b) | | presence | presence | 1.90 | 0.82 |
| (c) | | absence | absence | 1.91 | 0.88 |
| (d) | | presence | absence | 1.90 | 0.88 |
| (e) | Steel sheet coated with TiN coat after finish annealing | absence | absence | 1.92 | 0.71 |
| (f) | | absence | presence | 1.92 | 0.66 |
| (g) | | presence | absence | 1.91 | 0.72 |
| (h) | | presence | presence | 1.91 | 0.65 |

As seen from Table 1, the magnetic properties in the sheets (a) and (b) after the EB irradiation to the usual finish annealed grain oriented silicon steel sheet have $B_{10}$ value of 1.90~1.91 T and $W_{17/50}$ Value of 0.82 ~0.83 W/kg, wherein the $W_{17/50}$ value is raised by 0.05~0.06 W/kg as compared with the magnetic properties in the cases (c) and (d) not subjected to EB irradiation. Further, the magnetic properties in the sheets (f) and (h) when the finish annealed steel sheet is polished and subjected to ion plating for TiN coat and further to EB irradiation have $B_{10}$ value of 1.91~1.92 T and $W_{17/50}$ value of 0.65~0.66 W/kg, wherein the $W_{17/50}$ value is raised by 0.05~0.07 W/kg as compared with the magnetic properties in the cases (e) and (g) not subjected to EB irradiation.

Thus, products having an extra-low iron loss can be obtained by irradiating electron beam to the finish annealed grain oriented silicon steel sheet after the formation of insulation coating, or by polishing the surface of the finish annealed grain oriented silicon steel sheet to a mirror state, forming a thin tension coat of TiN thereon, forming an insulation coating and then performing EB irradiation.

FIG. 1 shows a change of iron loss property when the products after the treatments (a), (b), (f) and (h) in Table 1 are subjected to high temperature annealing. As seen from FIG. 1, in the cases (b) and (h) of Table 1, no degradation of iron loss property occurs even in the high temperature annealing treatment. Although the reason of causing no degradation of iron loss property even in the high temperature annealing treatment is not completely elucidated, it is considered that when EB irradiation is carried out on the insulation coating under vacuum, the change of material in the insulation coating composed mainly of magnesium phosphate and colloidal silica is particularly produced, to cause unhomogenization between EB irradiated zone and non-irradiated zone so that it is possible to perform magnetic domain refinement even at the high temperature annealing and consequently the degradation of iron loss property is prevented. Since such an insulation coating is formed by applying and baking a treating solution containing 7~24% of colloidal silica and 5~30% of magnesium phosphate as disclosed in Japanese patent application Publication No. 56-52,117, when electron beam is irradiated to the coating, it is possible to effectively reduce the iron loss by the change of material in the coating.

As apparent from the above, after the insulation coating is formed on the finish annealed steel sheet, or after the tension coat is formed on the mirror finished steel sheet and then the insulation coating is formed thereon, electron beam is irradiated to the insulation coating to charge the material of the coating, whereby the magnetic domain refinement can be achieved, and consequently the degradation of iron loss property is not caused even in the high temperature annealing treatment.

Experiment 2

A continuously cast slab of silicon steel containing C:0.043%, Si:3.41%, Mn:0.066%, Se:0.020%, Sb:0.023% and Mo:0.012% was heated at 1,350° C. for 4 hours and then hot rolled to obtain a hot rolled steel sheet of 2.0 mm in thickness.

The hot rolled steel sheet was subjected to a normalized annealing at 900° C. for 3 minutes and further to a cold rolling two times through an intermediate annealing at 950° C. for 3 minutes to obtain a final cold rolled steel sheet of 0.23 mm in thickness.

After the cold rolled steel sheet was subjected to decarburization and primary recrystallization annealing in a wet hydrogen atmosphere at 820° C., it was divided into two coils, to which was applied a slurry of an annealing separator (A) composed mainly of MgO or an annealing separator (B) composed of inert $Al_2O_3$ (70%), MgO (25%), $TiO_2$ (4%) and $SrSO_4$ (1%).

The thus coated coil was subjected to a secondary recrystallization annealing at 850° C. for 50 hours and further to a purification annealing in a dry hydrogen atmosphere at 1,200° C. for 6 hours.

Then, an insulation coating composed mainly of a phosphate and colloidal silica was formed on the coil treated with the annealing separator (A).

On the other hand, the coil treated with the annealing separator (B) was pickled to remove an oxide layer from the surface thereof and subjected to an electrolytic polishing into a mirror state having a center-line average roughness of 0.1 μm, to which was formed a TiN thin coat of 1.0 μm in thickness by means of a continuous ion plating apparatus (HCD process) and then an insulation coating composed mainly of a phosphate and colloidal silica was formed thereon.

Each of these treated steel sheets (A) and (B) was subjected to EB irradiation in a direction perpendicular to the rolling direction (acceleration voltage:60 kV, acceleration current:1.5 mA, beam diameter:0.1 mm, beam scanning space:5 mm).

In the EB irradiation, Ar gas was introduced into the vicinity of EB irradiated zone on the insulation coating in case of the treatment conditions (b) and (e).

After the EB irradiation, the coil was subjected to an annealing treatment in a nitrogen gas atmosphere at 800° C. for 5 hours. The magnetic properties of the resulting products are shown in the following Table 2.

TABLE 2

| | Test sheet | Treatment | EB irradiation | | | Magnetic properties | |
|---|---|---|---|---|---|---|---|
| | | | | condition | irradiation state | $B_{10}$ (T) | $W_{17/50}$ (W/kg) |
| (A) | Finish annealed steel sheet | (a) | presence | — | discharge occurred | 1.91 | 0.83 |
| | | (b) | presence | introduction of Ar gas | small discharge | 1.91 | 0.80 |
| | | (c) | absence | — | — | 1.90 | 0.88 |
| (B) | Steel sheet coated with TiN coat after finish annealing | (d) | presence | — | discharge occured | 1.92 | 0.68 |
| | | (e) | presence | introduction of Ar gas | small discharge | 1.92 | 0.65 |
| | | (f) | absence | — | — | 1.91 | 0.73 |

As seen from Table 2, the magnetic properties when the usual finish annealed grain oriented silicon steel sheet is subjected to EB irradiation [treatment condition (a)] have $B_{10}$ value of 1.91 T and $W_{17/50}$ value of 0.83 W/kg, which are raised by 0.01 T and 0.05 W/kg as compared with those in the treatment condition (c). In this case, discharge phenomenon occurs on the insulation coating in the course of the EB irradiation.

In case of the treatment condition (b), the $W_{17/50}$ value is raised by 0.08 W/kg, and the occurrence of discharge on the insulation coating becomes small in the course of the EB irradiation.

On the other hand, the magnetic properties in case of the treatment condition (d) that EB irradiation is performed after the formation of TiN coat on the polished steel sheet through ion plating have $B_{10}$ value of 1.92 T and $W_{17/50}$ value of 0.68 W/kg, which are raised by 0.01 T and 0.05 W/kg as compared with those in the case of the treatment condition (f). In this case, discharge phenomenon occurs on the insulation coating in the course of the EB irradiation. In case of the treatment condition (e), the $W_{17/50}$ value is raised by 0.08 W/kg and the occurrence of discharge on the insulation coating becomes small in the course of the EB irradiation.

Thus, the discharge property in the irradiation and the magnetic properties can be improved by irradiating electron beam to the insulation coating formed on the grain oriented silicon steel sheet and simultaneously introducing Ar gas into the vicinity of EB irradiated zone. Furthermore, the extra-low iron loss grain oriented silicon steel sheet products can be obtained with an improved discharge property by polishing the surface of the grain oriented silicon steel sheet into a mirror state, forming a thin tension coat of TiN on the mirror finished surface, forming an insulation coating thereon and irradiating electron beam to the insulation coating, during which Ar gas is introduced into the vicinity of EB irradiated zone.

As apparent from the above, after the insulation coating is formed on the finish annealed steel sheet, or after .the tension coat is formed on the mirror finished steel sheet and then the insulation coating is formed thereon, electron beam is irradiated to the insulation coating while adopting a means for the improvement of the discharge property during the irradiation, whereby the material of the coating can be changed to perform the magnetic domain refinement, and consequently the degradation of iron loss property is not caused even in the high temperature strain relief annealing.

Experiment 3

A continuously cast slab of silicon steel containing C:0.043%, Si:3.32%, Mn:0.066%, Se:0.020%, Sb:0.023% and Mo:0.013% was heated at 1,360° C. for 5 hours and then hot rolled to obtain a hot rolled steel sheet of 2.2 mm in thickness.

The hot rolled steel sheet was subjected to a normalized annealing at 900° C. for 3 minutes and further to a cold rolling two times through an intermediate annealing at 950° C. for 3 minutes to obtain a final cold rolled steel sheet of 0.23 mm in thickness.

After the cold rolled steel sheet was subjected to decarburization and primary recrystallization annealing in a wet hydrogen atmosphere at 820° C., a slurry of an annealing separator composed of inert $Al_2O_3$ (65%), MgO (30%), $TiO_2$ (3%) and $MgSO_4$ (2%) was applied thereto. Then, the thus coated steel sheet was subjected to a secondary recrystallization annealing at 850° C. for 50 hours and further to a purification annealing in a dry hydrogen atmosphere at 1,200° C. for 8 hours. Thereafter, the steel sheet was pickled to remove an oxide layer from the surface and subjected to an electrolytic polishing into a mirror state having a enter-line average roughness of 0.1 μm, onto which was formed a TiN thin coat of 1.0 μm in thickness by means of a continuous ion plating apparatus (HCD process).

Then, the steel sheet was subjected to any one of the treatments (a)~(l) as shown in the following Table 3. That is, in the treatments (a), (d), (g) and (j), electron beam was irradiated to the TiN thin coat in a direction perpendicular to the rolling direction at a space of 7 mm (acceleration voltage:60 kV, acceleration current:0.7 mA, beam diameter:0.1 mm). Thereafter, an insulation coating composed mainly of a phosphate and colloidal silica was formed on the thin coat in the treatment (a), while an insulation coating of Si3N4, $Al_2O_3$ or BN was formed on the thin coat in the treatment (d), (g) or (j). On the other hand, in the treatments (b), (e), (h) and (k), the TiN thin coat (thickness:1 μm) was formed through ion plating process, and then the insulation coating composed mainly of a phosphate and colloidal silica was formed thereon in case of the treatment (b) or the insulation coating composed of $Si_3N_4$, $Al_2O_3$ or BN was formed in case of the treatment (e), (h) or (k), and thereafter electron beam was irradiated at a space of 7 mm in a direction perpendicular to the rolling direction (acceleration voltage:60 kV, acceleration current:0.7 mA, beam diameter:0.1 mm) and further the strain relief annealing was carried out at 800° C. for 2 hours. In the treatments (c), (f), (i) and (l), the same procedure as in the treatments (b), (e), (h) and (k) was repeated except that the EB irradiation was not performed. The magnetic properties of the resulting products are shown in the following Table 3 together wIth the specific resistance of the insulation coating.

TABLE 3

| | Kind of coating | Treatment | EB irradiation on coating | Magnetic properties $B_{10}$ (T) | $W_{17/50}$ (W/kg) |
|---|---|---|---|---|---|
| (A) | Insulation coating composed of phosphate and colloidal silica (specific resistance: $8 \times 10^{12}$ Ω · cm) on TiN thin coat (1 μm) | (a) | Formation of insulation coating after EB irradiation on TiN thin coat | 1.92 | 0.65 |
| | | (b) | EB irradiation after the formulation of insulation coating | 1.92 | 0.66 |
| | | (c) | no EB irradiation | 1.92 | 0.70 |
| (B) | Insulation coating of $Si_3N_4$ (specific resistance: $4 \times 10^{14}$ Ω · cm ) on TiN thin coat (1μm) | (d) | Formulation of $Si_3N_4$ insulation coating after EB irradiation on TiN thin coat | 1.92 | 0.60 |
| | | (e) | EB irradiation after the formation of $Si_3N_4$ insulation coating | 1.92 | 0.62 |
| | | (f) | no EB irradiation | 1.92 | 0.66 |
| (C) | Insulation coating of $Al_2O_3$ (specific resistance: $2 \times 10^{11}$ Ω · cm) on TiN thin coat (1 μm) | (g) | Formation of $Al_2O_3$ insulation coating after EB irradiation on TiN thin coat | 1.92 | 0.61 |
| | | (h) | EB irradiation after the formation of $Al_2O_3$ inculation coating | 1.92 | 0.62 |
| | | (i) | no EB irradiation | 1.92 | 0.67 |
| (D) | Insulation coating of BN (specific resistance: $2 \times 10^{10}$ Ω · cm ) on TiN thin coat (1 μm) | (j) | Formation of BN insulation coating after EB irradiation on TiN thin coat | 1.92 | 0.62 |
| | | (k) | EB irradiation after the formation of BN insulation coating | 1.92 | 0.62 |
| | | (l) | no EB irradiation | 1.92 | 0.68 |

Figure 2A:
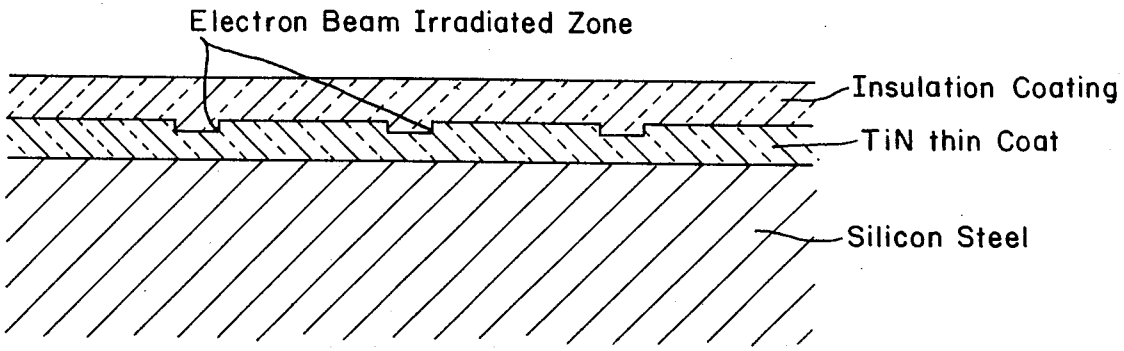
FIG. 2 is a schematically sectional view illustrating the reduction of iron loss on the coating after the electro beam irradiation.
Figure 2B:
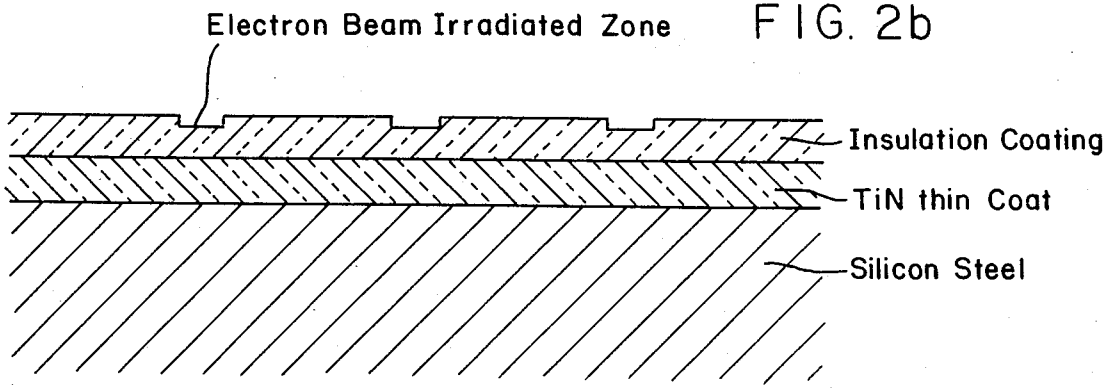

As seen from Table 3, it is noticed that in the treatments (a), (d), (g) and (j) or the treatments (b), (e), (h) and (k), the $W_{17/50}$ value is largely enhanced by 0.04~0.06 W/kg as compared with the treatments (c), (f), (i) and (l). The reason why the iron loss property is largely improved by the EB irradiation is due to the fact that different tension states are formed on the. coating by the EB irradiation as seen from FIG. 2*a* and 2*b*. In order to guarantee the sure insulating property in the silicon steel sheet, it is necessary that the specific resistance of the insulation coating is not less than $1 \times 10^{10}$ Ω·cm.

The steps of producing the grain oriented silicon steel sheets according to the invention will be described below.

As a base metal, there may be used any of conventionally well-known silicon steel compositions, a typical example of which includes:

① composition having C:0.01~0.06%, Si:2.50~4.5%, Mn:0.01~0.2%, Mo:0.003~0.1%, Sb:0.005~0.2% and 0.005~0.05% in total of at least one of S and Se;

② composition having C:0.01~0.08%, Si:2.0~4.0%, S:0.005~0.05%,.Al:0.005~0.06%, N:0.001~0.01%, Sn:0.01~0.5%, Cu:0.01~0.3% and Mn:0.01~0.2%; and ③ composition having C:0.011~0.06%, Si:2.0~4.0%, S:0.005—0.05%, B:0.0003~0.0040%, N:0.001~0.01% and Mn:0.01~0.2%.

Then, a series of manufacturing steps according to the invention will be described.

At first, the components having a given base metal composition are melted in the conventionally well-known steel making furnace such as LD converter, electric furnace, open hearth or the like and then cast into a slab. It is a matter of course that vacuum treatment or vacuum dissolution may be applied during the melting.

After the resulting slab is subjected to a hot rolling in the usual manner, the resulting hot rolled steel sheet is subjected to a normalized annealing at a temperature of 800~1,100° C. Then, the thus treated steel sheet is cold rolled to a final product thickness of 0.15 mm~0.35 mm by a heavy cold rolling at once or by a two-times cold rolling through an intermediate annealing usually performed at 850° C.~1,050° C. In the latter case, the draft is about 50%~80% in the first cold rolling and about 50%~85% in the second cold rolling.

The final cold rolled steel sheet is degreased and subjected to decarburization and primary recrystallization annealing in a wet hydrogen atmosphere at 750° C. 850° C.

Then, the thus treated surface of the steel sheet is coated with an annealing separator composed mainly of MgO. In this case, the annealing separator composed mainly of MgO is generally applied when the formation of forsterite layer is indispensable after the finish annealing. On the other hand, the feature that the forsterite layer is not formed is effective for simplifying the subsequent mirror finishing of the steel sheet surface. In the latter case, therefore, it is preferable to use an annealing separator composed of a mixture of MgO and not less than 50% of $Al_2O_3$, $ZrO_2$, $TiO_2$ or the like.

Thereafter, a secondary recrystallization annealing is performed for sufficiently growing secondary recrystallized grains with {110}<001> orientation. In general, this treatment is carried out by box annealing wherein the temperature of the steel sheet is rapidly raised to more than 1,000° C. and then held at that temperature for a given time.

Moreover, it is advantageous that the isothermal annealing at a temperature of 820° C. 900° C. is carried out in order to highly grow the secondary recrystallized texture with {110}<001> orientation. Besides, a slow temperature-rise annealing at a rate of 0.5~15° C./hr may be performed.

After the secondary recrystallization annealing, it is required that a purification annealing is carried out in a dry hydrogen atmosphere at a temperature above 1,100° C. for 1~20 hours.

Thereafter, an insulation coating composed mainly of a phosphate and colloidal silica is formed on the steel sheet surface.

Then, electron beam is irradiated to the insulation coating in a direction crossing the rolling direction of the sheet, preferably a direction inclined at an angle of 60°~90° with respect to the rolling direction, at a space of about 3~15 mm. The EB irradiation conditions are acceleration voltage of 10~100 kV, acceleration current of 0.005~10 mA and beam diameter of 0.005~1 mm. It is effective to irradiate the electron beam in form of dot or line. Moreover, it is desirable that when the EB irradiation is performed onto the insulation coating, an inert gas such as Ar, $N_2$ or the like is introduced into the vicinity of the EB irradiated zone for improving the discharge property.

Furthermore, the forsterite layer or oxide layer produced on the steel sheet surface after the purification annealing is removed from this surface by pickling with a strong acid such as sulfuric acid, nitric acid, hydrofluoric acid or the like, or by a mechanical removing process such as cutting, grinding or the like, whereby the magnetic properties are further improved.

Then, the steel sheet surface is rendered into a mirror finished state having a center line average roughness Ra of not more than 0.4 μm by the conventional process such chemical polishing, electropolishing or the like.

Thereafter, a thin coat of at least one layer composed of at least one of nitrides and/or carbides of Ti,.Zr, V, Nb, Ta, Cr, Mo, W, Mn, Co, Ni, Al, B and Si and oxides of Al, Ni, Cu, W, Si and Zn is formed on the steel sheet surface through CVD, ion plating or ion implantation process. In this case,, the electron beam is irradiated to the thin coat in a direction crossing the rolling direction, preferably a direction inclined at an angle of 60°~90° with respect to the rolling direction, at a space of about 3~15 mm under the same conditions as previously mentioned, if necessary.

After the formation of the thin coat, an insulation coating composed mainly of a phosphate and colloidal silica is formed thereon, or an insulation coating having a specific resistance of not less than $10^{10}$ Ω·cm and selected from $SiO_2$, $Si_3N_4$, SiC, $Al_2O_3$ and BN is formed through CVD, ion plating or ion implantation process. According to circumstances, such an insulation coating is subjected to EB irradiation in a direction crossing the rolling direction, preferably a direction inclined at an angle of 60°~90° with respect to the rolling direction, at a space of about 3~15 mm under the same conditions as mentioned above.

Moreover, the thus treated silicon steel sheet may be subjected to strain relief annealing and flattening heat treatment at a temperature above 600° C. without degrading the iron loss properties.

Figure 3:
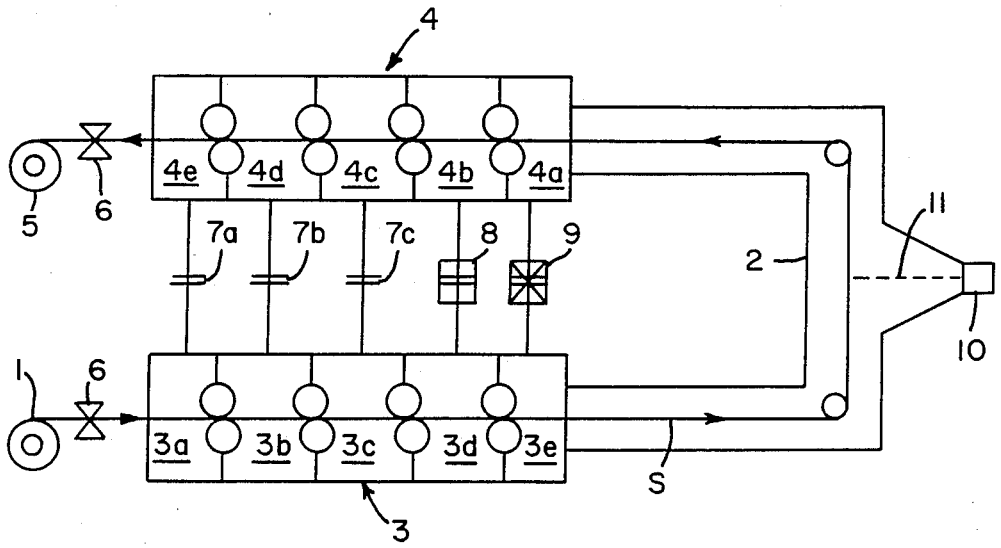
FIG. 3 is a diagrammatic view of an embodiment of the continuous treating apparatus according to the invention.

Although the irradiation of electron beam to the surface of the grain oriented silicon steel sheet in a direction crossing the rolling direction may be performed by using a batch type apparatus, it is efficient to perform the EB irradiation by means of a continuously treating apparatus as shown in FIG. 3.

In FIG. 3, numeral 1 is an uncoiler, numeral 2 a vacuum treating unit, numerals 3 and 4 exhaust unit rows arranged at entrance and delivery sides of the vacuum treating unit 2. Each of these exhaust unit rows 3, 4 consists of plural exhaust units 3*a*, 3*b*, 3*c*, 3*d*, 3*e* or 4*a*, 4*b*, 4*c*, 4*d*, 4*e* adjusted to gradually increase the vacuum degree toward the vacuum treating unit 2.

Numeral 5 is a coiler, numeral 6 a shear, numerals 7*a* 7*c*, rotary vacuum pumps, numeral 8 a combination of mechanical booster pump and rotary vacuum pump, and numeral 9 a combination of oil diffusion pump and rotary vacuum pump.

Numeral 10 is a device for irradiating electron beam 11.

Figure 4:
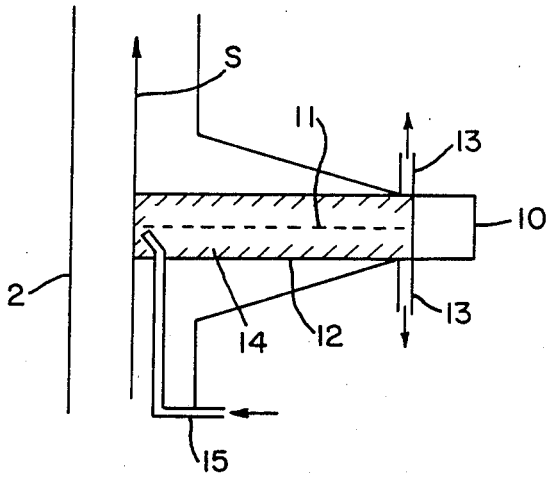
FIG. 4 is a diagrammatic view showing a detail vacuum treating unit in the apparatus of FIG. 3.

According to the invention, a high vacuum chamber 12 may be arranged in the vacuum treating unit 2 in order to more increase the vacuum degree in the electron beam irradiating zone as shown in FIG. 4. In the high vacuum chamber 12 are provided exhaust ports 13 connecting to oil diffusion pump and rotary vacuum pump for further vacuumizing the irradiation path of electron beam.

The irradiation of electron beam to the silicon steel sheet after the finish annealing is performed under vacuum as follows.

The grain oriented silicon steel sheet S coiled after the final treatment is decoiled from the uncoiler 1 and passed through the exhaust unit row 3 of continuous air-to-air system to introduce into the vacuum treating unit 2. In the vacuum treating unit 2, electron beam 11 is scanned at a space of 3~15 mm in a direction crossing the rolling direction of the sheet by means of the electron beam irradiating device 10. In the EB irradiation, when the vacuum degree is low, vacuum discharge is frequently caused to attenuate the effective treatment of electron beam and hence impede the reduction of iron loss in the steel sheet. In order to avoid such a trouble., therefore, it is preferable that the vacuum degree in the zone of irradiating electron beam to the steel sheet (shadowed zone 14) is made higher than that of the vacuum treating unit 2 a shown in FIG. 4. That is, when the vacuum degree of the vacuum treating unit 2 is $10^{-3}$~$10^{-4}$ mmHg, the vacuum degree of the shadowed zone 14 is sufficient to be about $1\times10-4$~$10-6$ mmHq.

In FIG. 4, numeral 15 is a pipe for introducing an inert gas such as Ar, $N_2$ or the like, through which the inert gas may be introduced into the vicinity of EB irradiated zone on the insulation coating in the silicon steel sheet to effectively reduce the occurrence of discharge.

The steel sheet subjected to the EB irradiation is passed from the delivery of the vacuum treating unit 2 through the exhaust unit row 4, which is adjusted to gradually increase the vacuum degree toward the vacuum treating unit 2, to the atmosphere and then wound on the coiler 5.

Thus, the magnetic domain refinement is effectively performed to improve the iron loss property.

The following examples are given in the illustration of the invention and are not intended as limitations thereof.

EXAMPLE 1

After an insulation coating composed of a phosphate and colloidal silica was formed on a grain oriented silicon steel sheet (thickness:0.23 mm) after the finish annealing, the thus treated steel sheet was wound on an uncoiler in the form of coil (about 8 tons) and then passed through the continuously treating apparatus shown in FIG. 3 at a line speed of 30 m/min, at where electron beam was irradiated to the steel sheet in its widthwise direction under such conditions that the acceleration voltage was 45 kV, the acceleration current was 120 mA, the scanning space was 8 mm, the beam diameter was 0.1 mm and the vacuum degree of the shadowed zone 14 was $10^{-5}$ mmHg.

The magnetic properties of the resulting product were $B_{10}=1.91$ T and $W_{17/50}=0.81$ W/kg.

EXAMPLE 2

A hot rolled silicon steel sheet containing C:0.055%, Si:3.25%, Mn:0.075%, Al:0.025%, S:0.030%, Sn:0.1% and Cu:0.05% was subjected to a cold rolling two times through an intermediate annealing at 1,000° C. for 3 minutes to obtain a cold rolled steel sheet of 0.20 mm in thickness. The cold rolled steel sheet was subjected to a decarburization treatment at 850° C., a secondary recrystallization annealing by raising temperature from 850° C. to 1,050° C. at a rate of 15° C./hr, and a purification annealing at 1,200° C. for 8 hours to obtain a grain oriented silicon steel sheet. After oxide layer produced on the steel sheet surface was removed by pickling, the steel sheet was subjected to an electropolishing into a mirror state having a center-line average roughness of Ra=0.08 μm, and a thin coat of TiN (0.8 μm) was formed on both surfaces of the steel sheet by means of an ion plating apparatus, and then an insulation coating composed mainly of a phosphate and colloidal silica was formed thereon.

Thereafter, electron beam was irradiated to the surface of the thus treated steel sheet under the following conditions by means of the apparatus shown in FIG. 3.

| | |
|---|---|
| Line speed | 35 m/min |
| Acceleration voltage | 40 kV |
| Acceleration current | 150 mA |
| Scanning space | 6 mm |
| Beam diameter | 0.15 mm |

The magnetic properties of the resulting product were $B_{10}=1.94$T and $W_{17/50}=0.60$ W/kg.

EXAMPLE 3

A hot rolled silicon steel sheet containing C:0.045%, Si:3.40%, Mn:0.066%, Mo:0.020%, Se:0.020% and Sb:0.025% was subjected to a normalized annealing at 900° C. for 3 minutes and further to a cold rolling two times through an intermediate annealing at 950° C. to obtain a final cold rolled steel sheet of 0.23 mm in thickness.

After the decarburization annealing in a wet hydrogen atmosphere at 820° C., the steel sheet was coated with a slurry of an annealing separator composed mainly of MgO, and subjected to a secondary recrystallization annealing at 850° C. for 50 hours and further to a purification annealing in a dry hydrogen atmosphere at 1,200° C. for 8 hours.

After the formation of an insulation coating composed mainly of a phosphate and colloidal silica, electron beam was lineally irradiated at a space of 7 mm in a direction substantially perpendicular to the rolling direction of the sheet (acceleration voltage: 45 kV, acceleration current:1.0 mA, beam diameter: 0.15 mm). Then, the annealing was carried out in a nitrogen atmosphere at 800° C. for 3 hours. The magnetic properties of the resulting product were $B_{10}$:1.91 T and $W_{17/50}$:0.82 W/kg.

EXAMPLE 4

A hot rolled siliCon steel sheet containing C:0.052%, Si:3.46%, Mn:0.077%, Al:0.024%, S:0.0020%, Cu:0.1% and Sn:0.06% was subjected to a normalized annealing at 1,130° C. for 3 minutes, quenched and then warm rolled at 300° C. to obtain a final cold rolled steel sheet of 0.20 mm in thickness.

After the decarburization annealing in a wet hydrogen atmosphere at 850° C., the steel sheet was coated with a slurry of an annealing separator composed of $Al_2O_3$ (80%), MgO (15%) and $ZrO_2$ (5%) and subjected to a secondary recrystallization annealing by raising temperature from 850° C. to 1,150° C. at a rate of 10° C./hr and further to a purification annealing in a dry hydrogen atmosphere at 1,200° C. for 8 hours.

After the oxide layer was removed by pickling, the steel sheet surface was rendered into a mirror state by chemical polishing with a mixed solution of 3% HF and $H_2O_2$, and then a thin coat (thickness:0.5~1.9 μm) selected from nitrides of (1) BN, (2) Ti(CN), (3) $Si_3N_4$, (4) VN, (5) ZrN, (6) $Cr_2N$, (7) AlN and (8) HfN, carbides of (9) ZrC, (10) HfC, (11) SiC, (12) TaC, (13) ZrC and (14) MnC and oxides of (15) ZnO, (16) NiO, (17) $SiO_2$, (18) WO, (19) $Al_2O_3$ and (20) CuO was formed thereon through CVD, ion plating (HCD process) or ion implantation process. Thereafter, an insulation coating composed mainly of a phosphate and colloidal silica was formed thereon.

Next, electron beam was linearly irradiated at a space of 10 mm in a direction perpendicular to the rolling direction of the sheet (acceleration voltage: 60 kV, acceleration current:0.8 mA, beam diameter: 0.05 mm) and the strain relief annealing was carried out at 800° C. for 2 hours. The magnetic properties of the resulting products are shown in the following Table 4.

TABLE 4

| | Thin coat (thickness) | Coating process * | Magnetic properties $B_{10}$ (T) | Magnetic properties $W_{17/50}$ (W/kg) |
|---|---|---|---|---|
| (1) | BN (0.9 μm) | A | 1.93 | 0.58 |
| (2) | Ti(CN) (1.2 μm) | B | 1.94 | 0.53 |
| (3) | $Si_3N_4$ (0.5 μm) | " | 1.93 | 0.52 |
| (4) | VN (1.5 μm) | " | 1.94 | 0.54 |
| (5) | ZrN (0.5 μm) | A | 1.94 | 0.53 |
| (6) | $Cr_2N$ (1.0 μm) | C | 1.94 | 0.54 |
| (7) | AlN (0.9 μm) | A | 1.95 | 0.55 |
| (8) | HfN (1.8 μm) | B | 1.94 | 0.56 |
| (9) | ZrC (0.8 μm) | " | 1.94 | 0.58 |
| (10) | HfC (1.2 μm) | " | 1.94 | 0.51 |
| (11) | SiC (0.8 μm) | C | 1.95 | 0.61 |

TABLE 4-continued

| | Thin coat (thickness) | Coating process * | Magnetic properties $B_{10}$ (T) | $W_{17/50}$ (W/kg) |
|---|---|---|---|---|
| (12) | TaC (0.7 μm) | B | 1.94 | 0.60 |
| (13) | ZrC (0.8 μm) | A | 1.94 | 0.61 |
| (14) | MnC (0.9 μm) | " | 1.94 | 0.65 |
| (15) | ZnO (0.9 μm) | " | 1.94 | 0.63 |
| (16) | NiO (1.2 μm) | B | 1.94 | 0.64 |
| (17) | $SiO_2$ (0.8 μm) | A | 1.94 | 0.62 |
| (18) | WO (1.9 μm) | B | 1.94 | 0.63 |
| (19) | $Al_2O_3$ (0.7 μm) | " | 1.93 | 0.64 |
| (20) | CuO (1.2 μm) | " | 1.94 | 0.61 |

* A: CVD process
B: Ion plating process
C: Ion implantation process

EXAMPLE 5

A hot rolled silicon steel sheet containing C:0.044%, Si:3.38%, Mn:0.072%, Se:0.020%, Sb:0.026% and Mo:0.15% was subjected to a normalized annealing at 1,000° C. for 1 minute and further to a cold rolling two times through an intermediate annealing at 950° C. for 3minutes to obtain a final cold rolled steel sheet of 0.18 mm in thickness. After the decarburization and primary recrystallization annealing was carried out in a wet hydrogen atmosphere at 820° C., the steel sheet was coated with a slurry of an annealing separator composed of $Al_2O_3$ (70%) and MgO (30%) and subjected to a secondary recrystallization annealing at 850° C. for 50 hours and further to a purification annealing in a dry hydrogen atmosphere at 1,200° C. for 10 hours.

After the removal of oxide layer by pickling, the steel sheet surface was rendered into a mirror state by chemical polishing with a mixed solution of 3% HF and $H_2O_2$, and then a thin tension coat (thickness:0.1 μm) selected from (1) TiN, (2) NbN, (3) $Mo_2N$, (4) $W_2N$, (5) CoN, (6) NiN, (7) TiC, (8) NbC, (9) $Mo_2C$, (10) WC, (11) CoC, (12) NiC, (13) VC, (14) CrC and (15) AlC was formed thereon through ion plating process (HCD process). Further, an insulation coating composed mainly of a phosphate and colloidal silica was formed thereon. Then, electron beam was linearly irradiated at a space of 8 mm in a direction perpendicular to the rolling direction of the sheet (acceleration voltage: 50 kV, acceleration current:0.9 mA, beam diameter: 0.1 mm), and the strain relief annealing was carried out in a nitrogen gas atmosphere at 800° C. for 2 hours.

The magnetic properties of the resulting products are shown in the following Table 5.

TABLE 5

| | Thin coat (thickness) | Magnetic properties $B_{10}$ (T) | $W_{17/50}$ (W/kg) |
|---|---|---|---|
| (1) | TiN (0.8 μm) | 1.92 | 0.54 |
| (2) | NbN (0.9 μm) | 1.92 | 0.56 |
| (3) | $Mo_2N$ (0.9 μm) | 1.92 | 0.58 |
| (4) | $W_2N$ (0.7 μm) | 1.92 | 0.59 |
| (5) | CoN (1.2 μm) | 1.92 | 0.58 |
| (6) | NiN (1.1 μm) | 1.92 | 0.60 |
| (7) | TiC (1.0 μm) | 1.92 | 0.61 |
| (8) | NbC (0.8 μm) | 1.92 | 0.62 |
| (9) | $Mo_2C$ (0.7 μm) | 1.92 | 0.55 |
| (10) | WC (0.9 μm) | 1.92 | 0.59 |
| (11) | CoC (0.9 μm) | 1.92 | 0.53 |
| (12) | NbC (1.2 μm) | 1.92 | 0.54 |
| (13) | VC (1.1 μm) | 1.92 | 0.53 |
| (14) | CrC (1.2 μm) | 1.92 | 0.56 |

TABLE 5-continued

| | Thin coat (thickness) | Magnetic properties $B_{10}$ (T) | $W_{17/50}$ (W/kg) |
|---|---|---|---|
| (15) | AlC (1.1 μm) | 1.92 | 0.58 |

EXAMPLE 6

A hot rolled silicon steel sheet containing C:0.043%, Si:3.42%, Mn:0.068%, Mo:0.012%, Se:0.020% and Sb:0.023% was subjected to a normalized annealing at 900° C. for 3 minutes and further to a cold rolling two times through an intermediate annealing at 950° C. to obtain a final cold rolled steel sheet of 0.23 mm in thickness.

After the decarburization annealing in a wet hydrogen atmosphere at 820° C., the steel sheet was coated with a slurry of an annealing separator composed mainly of MgO and subjected to a secondary recrystallization annealing at 850° C. for 50 hours and further to a purification annealing in a dry hydrogen atmosphere at 1,200° C. for 8 hours.

After the formation of an insulation coating composed mainly of a phosphate and colloidal silica, electron beam was linearly irradiated at a space of 7 mm in a direction substantially perpendicular to the rolling direction of the sheet (acceleration voltage: 55 kV, acceleration current:1.0 mA, beam diameter: 0.10 mm), during which $N_2$ gas was introduced into the vicinity of EB irradiated zone of the insulation coating, and then the annealing was carried out in a nitrogen atmosphere at 800° C. for 3 hours. The magnetic properties of the resulting product was $B_{10}$:1.91 T and $W_{17/50}$ :0.80 W/kg.

EXAMPLE 7

A hot rolled silicon steel sheet containing C:0.055%, Si:3.42%, Mn:0.075%, Al:0.025%, S:0.0025%, Cu:0.1% and Sn:0.06% was subjected to a normalized annealing at 1,130° C. for 3 minutes, quenched and warm rolled at 300° C. to obtain a final cold rolled steel sheet of 0.20 mm thickness After the decarburization annealing in a wet hydrogen atmosphere at 820° C., the steel sheet was coated with a slurry of an annealing separator composed of $Al_2O_3$ (80%) MgO (15%) and $ZrO_2$ (5%) and subjected to a secondary recrystallization annealing by raising temperature from 850° C. to 1,150° C. at a rate of 10° C./hr and further to a purification annealing in a dry hydrogen atmosphere at 1,200° C. for 8 hours.

After the removal of oxide layer by pickling, the steel sheet surface was rendered into a mirror state by chemical polishing with a mixed solution of 3% HF and $H_2O_2$, and a thin coat (0.5~1.9 μm) selected from nitrides of (1) BN, (2) Ti(CN), (3) $Si_3N_4$, (4) VN, (5) ZrN, (6) $Cr_2N$, (7) AlN and (8) HfN, carbides of (9) ZrC, (10) HfC, (11) SiC, (12) TaC, (13) ZrC and (14) MnC and oxides of (15)ZnO, (16) NiO, (17) $SiO_2$, (18) WO, (19) $Al_2O_3$ and (20) CuO was formed thereon through CVD, ion plating (HCD process) or ion implantation process. Then, an insulation coating composed mainly of a phosphate and colloidal silica was formed thereon.

Next, electron beam was linearly irradiated at a space of 8 mm in a direction perpendicular to the rolling direction of the sheet (acceleration voltage:50 kV, acceleration current:0.8 mA, beam diameter:0.05 mm), during which Ar gas was introduced into the vicinity of EB irradiated zone of the insulation coating, and further the strain relief annealing was carried out at 800° C. for 2 hours.

The magnetic properties of the resulting products are shown in the following Table 6.

TABLE 6

| | Thin coat (thickness) | Coating process * | Magnetic properties $B_{10}$ (T) | $W_{17/50}$ (W/kg) |
|---|---|---|---|---|
| (1) | BN (0.9 μm) | A | 1.93 | 0.56 |
| (2) | Ti(CN) (1.2 μm) | B | 1.94 | 0.51 |
| (3) | $Si_3N_4$ (0.5 μm) | " | 1.93 | 0.50 |
| (4) | VN (1.5 μm) | " | 1.94 | 0.52 |
| (5) | ZrN (0.5 μm) | A | 1.94 | 0.51 |
| (6) | $Cr_2N$ (1.0 μm) | C | 1.94 | 0.52 |
| (7) | AlN (0.9 μm) | A | 1.95 | 0.52 |
| (8) | HfN (1.8 μm) | B | 1.94 | 0.53 |
| (9) | ZrC (0.8 μm) | " | 1.94 | 0.55 |
| (10) | HfC (1.2 μm) | " | 1.94 | 0.50 |
| (11) | SiC (0.8 μm) | C | 1.95 | 0.60 |
| (12) | TaC (0.7 μm) | B | 1.94 | 0.58 |
| (13) | ZrC (0.8 μm) | A | 1.94 | 0.60 |
| (14) | MnC (0.9 μm) | " | 1.94 | 0.63 |
| (15) | ZnO (0.9 μm) | " | 1.94 | 0.61 |
| (16) | NiO (1.2 μm) | B | 1.94 | 0.62 |
| (17) | $SiO_2$ (0.8 μm) | A | 1.94 | 0.60 |
| (18) | WO (1.9 μm) | B | 1.94 | 0.62 |
| (19) | $Al_2O_3$ (0.7 μm) | " | 1.93 | 0.61 |
| (20) | CuO (1.2 μm) | " | 1.94 | 0.59 |

* A: CVD process
B: Ion plating process
C: Ion implantation process

EXAMPLE 8

A slab of silicon steel containing C:0.042%, Si:3.32%, Mn:0.048%, S:0.031%, B:0.0028% and N:0.0062% was heated at 1,300° C. for 4 hours and then hot rolled to obtain a hot rolled steel sheet of 1.8 mm in thickness. Then, the steel sheet was subjected to a normalized annealing at 950° C. for 3 minutes and further to a warm rolling at 350° C. to obtain a final cold rolled steel sheet of 0.23 mm in thickness. After the decarburization and primary recrystallization annealing was carried out in a wet hydrogen atmosphere at 830° C., the steel sheet was coated with a slurry of an annealing separator composed of MgO (35%), $Al_2O_3$ (62%) and $TiO_2$ (3%) and subjected to a secondary recrystallization annealing by raising temperature from 850° C. to 1,050° C. at a rate of 10° C./hr and further to a purification annealing in a dry hydrogen atmosphere at 1,250° C. for 4 hours.

After the removal of oxide layer by pickling, the steel sheet surface was rendered into a mirror state having a center-line average roughness of Ra=0.08 μm by electropolishing, and then a Ti(CN) thin coat of 0.8 μm in thickness was formed thereon by ion plating (HCD process). Next, electron beam was irradiated at a space of 6 mm in a direction perpendicular to the rolling direction of the sheet (acceleration voltage:65 kV, acceleration current:1.0 mA, beam :0.15 mm). After the formation of an insulation coating composed mainly of a phosphate and colloidal silica, the strain relief annealing was carried out at 850° C. for 2 hours. The magnetic properties of the resulting product were $B_{10}$:1.92T and $W_{17/50}$:0.63 W/kg.

EXAMPLE 9

A slab of silicon steel containing C:0.062%, Si:3.36%, Mn:0.079%, acid soluble Al:0.029%, Se:0.021% and N:0.069% was heated at 1,420° C. for 8 hours and then hot rolled to obtain a hot rolled steel sheet of 2.0 mm in thickness. The hot rolled steel sheet was subjected to a cold rolling two times through an intermediate annealing at 1,000° C. for 3 minutes to obtain a final cold rolled steel sheet of 0.20 mm in thickness. In the intermediate annealing, the temperature rising from 500° C. to 900° C. was performed by rapid heating treatment of 15° C./sec and the temperature dropping from 900° C. to 500° C. after the intermediate annealing was performed by rapid cooling treatment of 18° C./sec.

After the decarburization annealing in a wet hydrogen atmosphere at 850° C., the steel sheet was coated with a slurry of an annealing separator composed of MgO (40%)and $Al_2O_3$ (60%) and subjected to a secondary recrystallization annealing by raising temperature from 850° C. to 1,100° C. at a rate of 8° C./hr and further to a purification annealing in a dry hydrogen atmosphere at 1,220° C. for 6 hours.

After the removal of oxide layer by pickling and mechanical polishing, the steel sheet surface was rendered into a mirror state having a center-line average roughness of Ra=0.07 μm by electropolishing, and a Ti(CN) thin coat (0.8 μm) was formed thereon by ion plating.

Thereafter, the steel sheet was subjected to anyone of treatments (a) as shown in the following Table 7. That is, in the treatments (a), (d), (g), (j) and (m), electron beam was irradiated to the thin coat at a space of 7 mm in a direction perpendicular to the rolling direction of the sheet (acceleration voltage:65 kV, acceleration current:1.2 mA, beam diameter:0.15 mm), and then an insulation coating of $SiO_2$, $Si_3N4$, $Al_2O_3$, BN or SiC+$SiO_2$ was formed thereon. On the other hand, in the treatments (b), (e), (h), (k) and (n), an insulation coating of $SiO_2$, $Si_3N_4$, $Al_2O_3$ , BN or SiC+$SiO_2$ was formed on the thin coat, and then the EB irradiation was performed under the same conditions as described above. The treatments (c), (f), (i), (l) and (o) were the same as in the treatments (b), (e), (h), (k) and (n) except for the absence of the EB irradiation. Then, the strain relief annealing was carried out at 800° C. for 3 hours.

The magnetic properties of the resulting products are also shown in Table 7.

TABLE 7

| Kind of coating | Treatment | EB irradiation on coating | Magnetic properties $B_{10}$ (T) | $W_{17/50}$ (W/kg) |
|---|---|---|---|---|
| (A)* Insulation coating of $SiO_2$ (specific resistance: $3 \times 10^{13}$ Ω · cm) on Ti(CN) thin coat (0.8 μm) | (a) | Foramtion of $SiO_2$ insulation coating after EB irradiation on Ti(CN) thin coat | 1.95 | 0.61 |
| | (b) | EB irradiation after the formation of $SiO_2$ insulation coating | 1.95 | 0.62 |
| | (c) | no EB irradiation | 1.94 | 0.68 |

TABLE 7-continued

| Kind of coating | Treatment | EB irradiation on coating | Magnetic properties $B_{10}$ (T) | $W_{17/50}$ (W/kg) |
|---|---|---|---|---|
| (B)** Insulation coating of $Si_3N_4$ (specific resistance: $8 \times 10^{14}\ \Omega \cdot cm$) on Ti(CN) thin coat (0.8 μm) | (d) | Foramtion of $Si_3N_4$ insulation coating after EB irradiation on Ti(CN) thin coat | 1.94 | 0.60 |
| | (e) | EB irradiation after the formation of $Si_3N_4$ insulation coating | 1.94 | 0.63 |
| | (f) | no EB irradiation | 1.94 | 0.67 |
| (C)** Insulation coating of $Al_2O_3$ (specific resistance: $4 \times 10^{11}\ \Omega \cdot cm$) on Ti(CN) thin coat (0.8 μm) | (g) | Formation of $Al_2O_3$ insulation coating after EB irradiation on Ti(CN) thin coat | 1.95 | 0.60 |
| | (h) | EB irradiation after the formation of $Al_2O_3$ insulation coating | 1.95 | 0.61 |
| | (i) | no EB irradiation | 1.94 | 1.68 |
| (D)*** Insulation coating of BN (specific resistance: $6 \times 10^{10}\ \Omega \cdot cm$) on Ti(CN) thin coat (0.8 μm) | (j) | Formation of BN insulation coating after EB irradiation on Ti(CN) thin coat | 1.96 | 0.59 |
| | (k) | EB irradiation after the formation of BN insulation coating | 1.95 | 0.59 |
| | (l) | no EB irradiation | 1.94 | 0.68 |
| (E)** Insulation coating of $SiC + SiO_2$ (specific resistance: $6 \times 10^{11}\ \Omega \cdot cm$) on Ti(CN) thin coat (0.8 μm) | (m) | Formation of $SiC + SiO_2$ insulation coating after EB irradiation on Ti(CN) thin coat | 1.95 | 0.58 |
| | (n) | EB irradiation after the formation of $SiC + SiO_2$ insulation coating | 1.95 | 0.62 |
| | (o) | no EB irradiation | 1.94 | 0.68 |

*CVD,
**Ion plating,
***Ion implantation

What is claimed is:

1. An apparatus for continuously reducing iron loss in a moving grain oriented silicon steel sheet, comprising means for forming an insulation coating compound composed mainly of a phosphate and colloidal silaca on the grain oriented silicon steel, a vacuum treating unit provided with a sheet entrance and exit and an electron beam irradiation device for irradiating an electron beam to the silicon steel sheet in a direction crossing the direction of movement of the sheet, means for applying an inert gas into the vicinity of the electron beam irradiated zone and a pair of exhaust unit rows arranged at the entrance and exit of said treating unit and adjusted to gradually increase the degree of vacuum as the sheet moves toward said treating unit.

2. The apparatus according to claim 1, wherein said vacuum treating unit is provided with a high vacuum chamber for raising the degree of vacuum at the electron beam irradiated zone.

* * * * *